US006257750B1

(12) United States Patent
Strasser et al.

(10) Patent No.: US 6,257,750 B1
(45) Date of Patent: Jul. 10, 2001

(54) ILLUMINATING FIRE HOSE

(76) Inventors: Richard T. Strasser, 328 Kettle Creek Rd.; Roger J. Brown, 125 Westwood Dr., both of Toms River, NJ (US) 08753

( * ) Notice: Subject to any disclaimer, the term of this patent is extended or adjusted under 35 U.S.C. 154(b) by 0 days.

(21) Appl. No.: 09/568,116

(22) Filed: May 10, 2000

Related U.S. Application Data

(60) Provisional application No. 60/143,263, filed on Jul. 9, 1999.

(51) Int. Cl.[7] ..... F21V 5/00

(52) U.S. Cl. ..... 362/559; 362/34; 362/84; 362/96; 362/234; 362/562; 362/800

(58) Field of Search ..... 362/559, 562, 362/96, 101, 84, 34, 252, 234, 253, 293, 800

(56) References Cited

U.S. PATENT DOCUMENTS

| | | | |
|---|---|---|---|
| D. 382,501 | 8/1997 | Clement | D10/109 |
| 2,052,404 | 8/1936 | Kearsley | 240/2 |
| 2,855,497 | 10/1958 | Bacon | 240/6.4 |
| 3,810,250 | 5/1974 | McGregor | 240/6.4 |
| 4,179,160 | 12/1979 | Sabo | 299/12 |
| 4,291,839 | 9/1981 | Brett | 239/289 |
| 4,471,412 | 9/1984 | Mori | 362/32 |
| 4,489,308 | 12/1984 | Logan, Jr. et al. | 340/286 |
| 4,844,000 | 7/1989 | Clement | 116/205 |
| 4,901,922 | 2/1990 | Kessener et al. | 239/12 |
| 5,027,741 | 7/1991 | Smith et al. | 116/205 |
| 5,042,613 | 8/1991 | Hermann | 182/18 |
| 5,115,973 | 5/1992 | Fuller et al. | 239/20 |
| 5,130,909 | 7/1992 | Gross | 361/153 |
| 5,140,301 | 8/1992 | Watanabe | 340/332 |
| 5,267,129 | 11/1993 | Anderson | 362/96 |
| 5,326,052 | 7/1994 | Krispin et al. | 244/135 |
| 5,333,639 | 8/1994 | Nelson | 137/150 |
| 5,491,617 | 2/1996 | Currie | 362/96 |
| 5,539,624 | 7/1996 | Dougherty | 362/32 |
| 5,572,183 | 11/1996 | Sweeney | 340/332 |
| 5,623,890 | 4/1997 | Lenske | 116/205 |
| 5,709,455 | 1/1998 | Danekas et al. | 362/83.3 |
| 5,795,053 | 8/1998 | Pierce | 362/96 |
| 5,815,068 | 9/1998 | Vadseth | 340/332 |
| 5,873,647 | 2/1999 | Kurtz et al. | 362/96 |
| 5,988,101 | 11/1999 | Jacobs et al. | 116/205 |

*Primary Examiner*—Stephen Husar
(74) *Attorney, Agent, or Firm*—Lerner, David, Littenberg, Krumholz & Mentlik, LLP

(57) ABSTRACT

An illuminating fire hose includes a fire hose having a first end, a second end, an interior wall and an exterior wall remote from the interior wall. The fire hose has at least light emitting element exposed at the exterior surface of the fire hose for selectively emanating light. The light emitting element is preferably attached to the exterior surface of the fire hose using an adhesive or securing threads for sewing the light emitting element to the exterior surface of the hose. The light emitting element may include a fiber optic cable, a chemiluminescent cable or a series of light emitting diodes. The light emitting element is activated during a fire to provide fire fighters with a visible marker that may be seen in a darkened and/or smoke-filled enclosure.

37 Claims, 6 Drawing Sheets

ILLUMINATING FIRE HOSE

CROSS-REFERENCE TO RELATED APPLICATIONS

The present application claims benefit under 35 U.S.C. §120 of U.S. Provisional Application No. 60/143,263, filed Jul. 9, 1999 and entitled "Moon Hose," the disclosure of which is hereby incorporated by reference herein.

FIELD OF THE INVENTION

The present invention is generally related to safety devices for fire fighters and is more particularly directed to fire fighting hoses having indicia attached to the exterior surfaces thereof for assisting fire fighters to exit from a darkened and/or smoked-filled room or building.

BACKGROUND OF THE INVENTION

When fighting a fire in a burning building, it is easy for a fire fighter to become disoriented and/or lose his or her sense of direction. This is particularly true when an individual is in a dark or smoke-filled room. Unfortunately, there have been far too many incidences of fire fighters becoming disoriented inside burning buildings, resulting in injuries and deaths. As a result, there is a tremendous need to improve safety conditions for fire fighters.

There have been many efforts directed to improving safety conditions for fire fighters. Among these are U.S. Design Pat. No. 382,501 to Clement which teaches a direction indicating band attachable to the exterior surface of a fire fighting hose to direct an individual toward the exit of a building. U.S. Pat. No. 4,844,000 to Clement discloses a direction indicating clamp that may be attached to a fire fighting hose. The direction indicating clamp partially surrounds the hose with an encircling elongated band. The band has protruding elongated extension fingers that point toward the exit of the building.

U.S. Pat. No. 5,027,741 to Smith et al. discloses another fire fighting hose which indicates an escape route from a fire. The fire fighting hose is a conventional hose having an outer surface of fire resistant fibers that are woven into the exterior canvas surface of the hose. The fibers are generally stiff so as to maintain a substantially constant angle with respect to the exterior surface of the hose, thereby forming a brush surface surrounding the hose. The brush surface is rough to the touch in the direction of the fire and smooth to the touch in the opposing direction, i.e., the direction to the exit of the building.

U.S. Pat. No. 5,623,890 to Lenske discloses a fire fighting hose having a coupling that indicates the direction to the exit of a building. The coupling has a cylindrical body with a plurality of lugs attached to the outside surface of the cylindrical body. Each lug features directional extensions and a raised indicia (e.g., the word "exit") to direct the fire fighter to the exit. The coupling component has a threaded extension so that the component may be threaded to a female coupling component.

Although the above-mentioned safety devices provide some assistance, there remains a need for a fire fighting hose having visual indicia on the exterior surface thereof that enables a fire fighter to visually see where the fire fighting hose is located, and then follow the visual indicia to the exit of a building.

SUMMARY OF THE INVENTION

Preferred embodiments of the present invention are preferably directed to providing an illuminating fire hose which emanates visible light to enable a fire fighter to quickly locate the hose in a dark and/or smoke-filled environment. The present invention may also provide a life-line for a trapped fire fighter, whereby a rescue or search team may follow a light path to locate the trapped individual.

In accordance with certain preferred embodiments of the present invention, an illuminating fire hose includes a fire hose, such as a standard fire hose having an interior section that contacts water and an exterior surface remote therefrom. Preferred fire hoses include those having an inner hose section comprising rubber and an outer hose section comprising canvas, polyester, or any other material able to withstand the heat of a fire, that is securable (e.g. bonded) to the exterior surface of the rubber hose section. The hoses also preferably have metallic male and female hose couplings so that the hoses may be coupled to a water source and/or to the couplings of other fire hoses. The fire hose may also include two or more hose sections, each hose section having a first end and a second end remote therefrom. Each end of the fire hose preferably has one of the above-mentioned male and/or female hose couplings.

The illuminating fire hose also preferably includes at least one light emitting element exposed at the exterior surface of the hose. As used herein, the term "light emitting element" means any element that is capable of emanating light or illuminating. The light emitting element may also be continuously exposed at the exterior surface of the hose so that the entire length of the light emitting element is visible at the exterior surface of the hose. In certain preferred embodiments, it is desirable that the light emitting element be exposed along the entire length of the fire hose so that a trapped and/or disoriented fire fighter may easily locate the fire hose by visually observing the light projecting from the fiber optic cable. The light emitting element may be one or more fiber optic fibers, a fiber optic cable, a chemiluminescent cable or line, or as a server of light emitting diodes.

The light emitting element may be attached to the exterior surface of the fire hose by an adhesive, such as an epoxy adhesive. The adhesive is preferably flexible so that the hose may bend and flex during use without detaching the light emitting element from the exterior surface of the hose. In certain preferred embodiments, the adhesive is substantially transparent so that light emanating from the light emitting element may pass through the adhesive. In other preferred embodiments, the light emitting element is attached to the exterior surface of the fire hose by sewing the element to the outer surface of the hose. In one preferred embodiment, fibers or monofilaments are used for sewing the element to the exterior surface of the hose. The monofilaments may be substantially transparent. In still other embodiments, the light emitting element may include one or more individual optical fiber cables that are woven into the outer jacket of the hose.

In certain preferred embodiments, the overall length of the light emitting element is longer than the distance between the first and second ends of the fire hose. In these particular embodiments, the light emitting element may have a first end attached to the hose, adjacent a first end of the hose. The light emitting element then extends away from the first end of the hose toward the second end. At the second end of the hose, the light emitting element preferably loops back on itself at a looped portion of the light emitting element and then extends back toward the first end of the fire hose. When the light emitting element is a fiber optic cable or one or more fiber optic fibers, a first end and/or a second end of the fiber optic cable may be optically coupled with a light source for transmitting light through the fiber optic cable. The light transmitted through the fiber optic cable then emanates from the sidewalls of the cable to provide visible lighting along the exterior surface of the hose. This visible light is particularly helpful when a fire fighter must quickly locate the fire hose in a dark and/or smoke-filled room.

In another preferred embodiment, the light emitting element is wrapped around and attached to the exterior surface of the fire hose in a coil-like configuration. Thus, the light emitting element provides illumination completely around the exterior surface of the fire hose. This embodiment may be particularly useful for illuminating fire hoses having two or more fire hose sections coupled to one another.

In certain preferred embodiments, a light source such as a laser device creates light that is transmitted through one or more fiber optic cables attached to one or more fire hoses. The light source may be attached to an optical coupler or connector having multiple receiver ports for receiving the ends of the optical fiber cables for optically coupling the fiber optic cables with the light source. As a result, light created by the light source may be transmitted through the fiber optic cables to provide light along the exterior surfaces of the fire hoses.

In certain preferred embodiments, an end of a fiber optic cable terminates adjacent an end of a fire hose. The end of the fiber optic cable is optically coupled with a reflective element such as a reflective end cap that reflects the light emanating from the end of the fiber optic cable. The light emanating from the reflective end cap may have a brighter intensity than the light emanating from the side walls of the fiber optic cables. The reflective end cap is particularly useful for assisting fire fighters in locating an end of a fire hose. This may be particularly useful for coupling the end of the fire hose to another fire hose and/or quickly spotting the end of the fire hose so as to find the exit of a building.

In certain preferred embodiments, the light emitting element may incorporate chemiluminescent technology whereby two or more chemicals are mixed together to produce illumination. Items incorporating chemiluminescent technology are commonly sold under the trademarks CYALUME® and SNAPLIGHT®. In this particular embodiment, a line or cable may be attached to the exterior surface of a fire hose. During a fire, the line or cable may be bent so as to mix two or more chemicals together to produce illuminating light.

In yet further preferred embodiments, a color wheel or color filter may be used to change the color of the light passing through the light emitting element. In these embodiments, different colors may be used to send different messages along the length of the hose. For example, the color green may mean "all clear" and the color red may be a signal to evacuate a building.

In other preferred embodiments, the light emitting element may include a series of light emitting diodes that are exposed at the exterior surface of the fire fighting hose. The series of light emitting diodes may include a clear protective strip overlying a series of individual light emitting diodes. The individual light emitting diodes are preferably interconnected with one another by a conductive trace. The light emitting diodes may have different colors such as white, red, green, yellow, orange and blue. These colors may be selectively activated to provide fire fighters with a message. For example, the green diodes may be activated to indicate that conditions within a burning building are safe. However, the red diodes may be activated to provide an indication that an emergency condition exists within the building and that fire fighters should exit the building as quickly as possible. The light emitting diodes may also be selectively activated to provide a pulse of light which moves toward the first end of the fire hose to indicate the direction to the first end. This may be particularly useful for disoriented fire fighters who are able to locate the fire hose, yet have no indication as to which end of the hose is the first end.

In still other preferred embodiments of the present invention, a combination includes a fire hose having a first end and a second end, an interior wall and an exterior wall remote from the interior wall. The combination includes one or more fiber optic fibers attached to the exterior surface of the fire hose. The fiber optic cable extends between the first and the second ends of the fire hose and is preferably continuously exposed at the exterior surface of the fire hose. The combination also preferable includes a light source that is optically coupled to at least one end of the fiber optic cable for transmitting light through the fiber optic cable. The transmitted light is preferable visible along substantially an entire length of the fiber optic cable and substantially the entire length of the hose. In operation, the combination provides visible light emanating from a fire hose that may be seen by individuals working in darkened and/or smoke-filled rooms. The individuals may rely on the visual light to identify the location of the fire hose and to follow the light path to the exit of a building.

These and other preferred embodiments are described in more detail below.

DETAILED DESCRIPTION OF THE PREFERRED EMBODIMENTS

Figure 1:
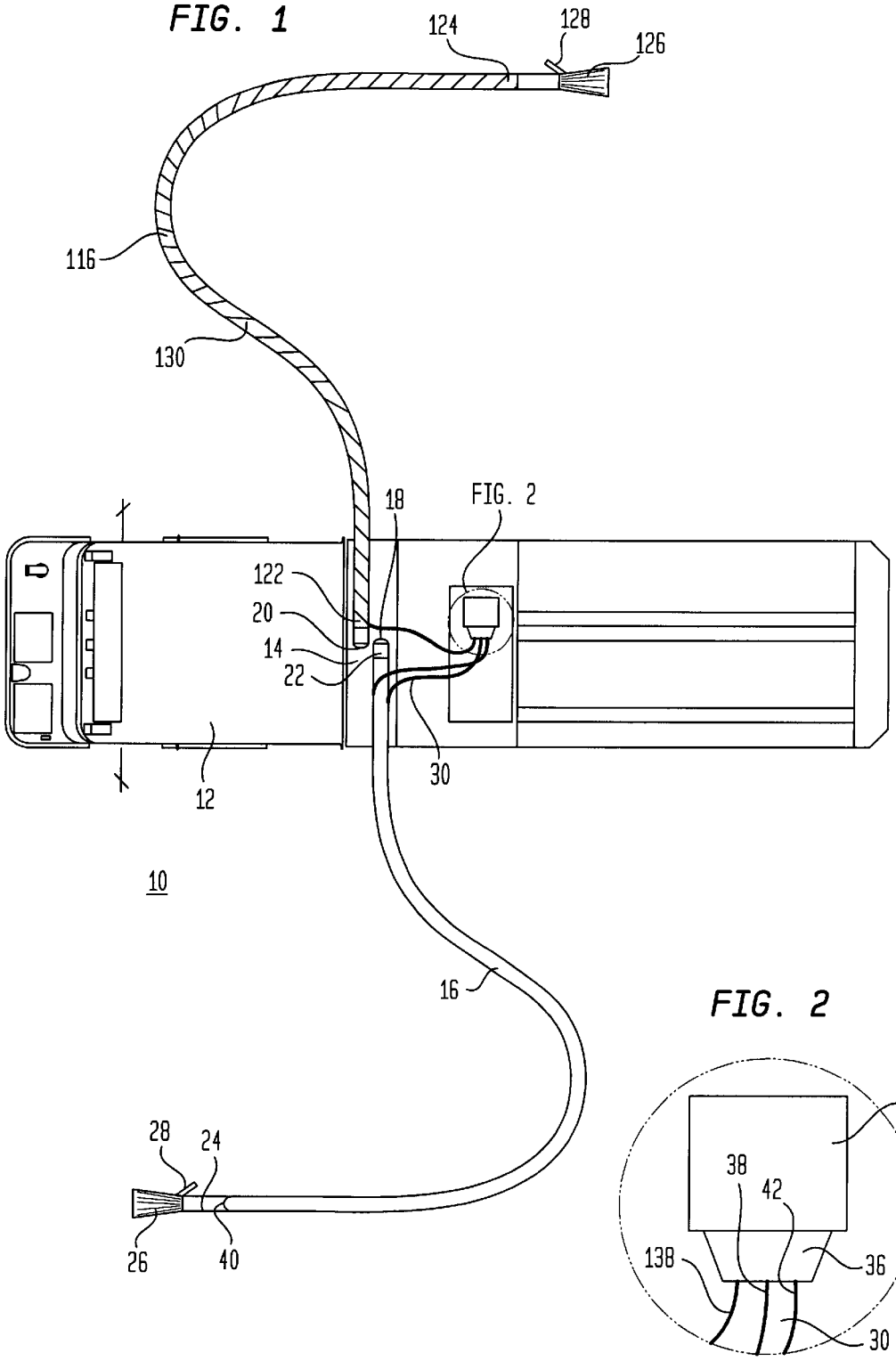
FIG. 1 shows a perspective view of a fire fighting system including illuminating fire hoses, in accordance with certain preferred embodiments of the present invention.

FIG. 1 shows a top view of an illuminating system for fire hoses in accordance with certain preferred embodiments of the present invention. The illuminating system 10 includes a source of water 12, such as a fire truck or fire hydrant, having a platform 14 for receiving one or more fire hoses 16, 116. In the particular embodiment shown in FIG. 1, the platform 14 includes water supply coupling 18 for the first fire hose 16 and a second water supply coupling 20 for the second fire hose 116. The first fire hose 16 includes a first end 22 that is coupled to first water supply coupling 18 and a second end 24 remote therefrom. The second end 24 of the first hose 16 is coupled with a spray nozzle 26 having control handle 28 for opening and closing the spray nozzle. A light emitting element such as a fiber optic cable 30 extends along the entire exterior surface of the fire hose 16. Although the light emitting element in this particular embodiment includes a fiber optic cable, it is contemplated that the light emitting element may also include a chemiluminescent line or a series of light emitting diodes. As will be described in more detail below, fiber optic cable 30 is preferably attached to the exterior surface of fire hose 16 by an adhesive, such as an epoxy adhesive that is substantially transparent for allowing light to pass therethrough.

Figure 2:
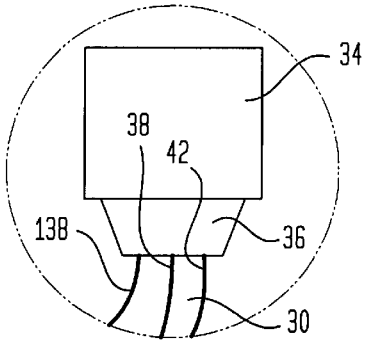
FIG. 2 shows an expanded view of a section of FIG. 1 including a light source and an optical coupler, in accordance with certain preferred embodiments of the present invention.

Referring to FIGS. 1 and 2, one or more ends of the fiber optic cable 30 are optically coupled with a light source 34. The light source 34 preferably includes a laser device or one or more light generators for creating light that will be transmitted through the fiber optic cable 30. In certain preferred embodiments, the light source 34 includes a color wheel or color filter (not shown) that allows an operator to selectively modify the color of the light transmitted through the fiber optic cable 30. The light source 34 also preferably includes a multiport optical coupler 36 attached thereto that is adapted for forming an optical linkage between the light source 34 and the ends of fiber optic cable 30. In the particular embodiment shown in FIG. 2, the multiport optical coupler 36 includes at least three ports or receptacles for receiving the ends of fiber optic cables. The optical fiber 30 attached to the exterior surface of first fire hose 16 has a first end 38 optically coupled with optical coupler 36. The fiber optic cable 30 then extends along the exterior surface of the hose toward the second end 24 of the fire hose 16. Near the second end 24 of the fire hose, fiber optic cable 30 loops back, preferably at loop portion 40 and then extends back toward the first end 22 of fire hose 16. Fiber optic cable 30 terminates at second end 42, which is also optically coupled to light source 34 via optical coupler 36. Thus, both the first and second ends 38, 42 of the fiber optic cable 30 are coupled with light source 34 via optical coupler 36.

During operation of illuminating fire hose 16, the water source 12 provides water which is pumped through hose 16 to nozzle end 26. When the first end 22 of hose 16 is coupled to water source 12, the ends of fiber optic cable 30 are also coupled to light source 34 via optical coupler 36. The light source 34 provides light that is transmitted through the entire length of optical fiber cable 30 so as to provide visible light at the exterior surface of the fire hose 16. As a result, a fire fighter in a dark or smoke filled room will be able to see the light emanating from the fiber optic cable for determining the location of the hose and then follow the fire hose to the exit of the a room or building.

FIG. 1 also shows a second embodiment of an illuminating fire hose having an optical fiber cable wrapped around and attached to the exterior surface of the hose in a coil-like manner. The second fire hose 116 has a first end 122 coupled to water source 12 at water source coupling 20. Second fire hose 116 include a second end 124 remote therefrom having nozzle 126 attached thereto. Nozzle 126 includes nozzle control handle 128 for opening, closing and controlling the spray of water from nozzle 126. The exterior surface of second fire hose 116 includes optical fiber cable 130 attached to the exterior surface of the fire hose. The optical fiber cable 130 is wrapped around the exterior surface of second fire hose 116 in a coil-like manner so that the light transmitted through optical fiber cable 130 may be seen completely around the exterior surface of second fire hose 116. A first end of optical fiber cable 138 is coupled with light source 34 at optical coupler 36.

Figure 3A:
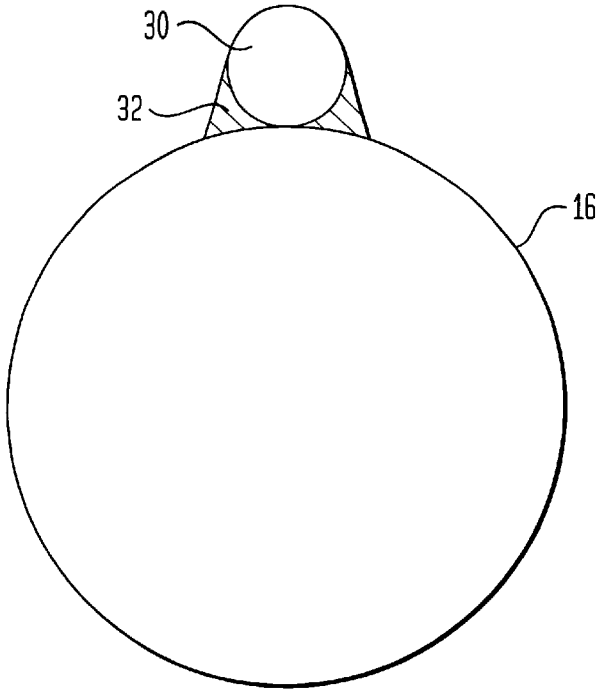
FIG. 3A shows a cross-sectional view of a fire fighting hose including a fiber optic cable attached to an exterior surface of the hose, in accordance with certain preferred embodiments of the present invention.

FIG. 3A shows one embodiment wherein fiber optic cable 30 is attached to the exterior surface of hose 16 using substantially transparent adhesive 32. The adhesive 32 is preferably flexible so that the fiber optic cable 30 remains attached to the hose when the hose flexes and bends.

Figure 3B:
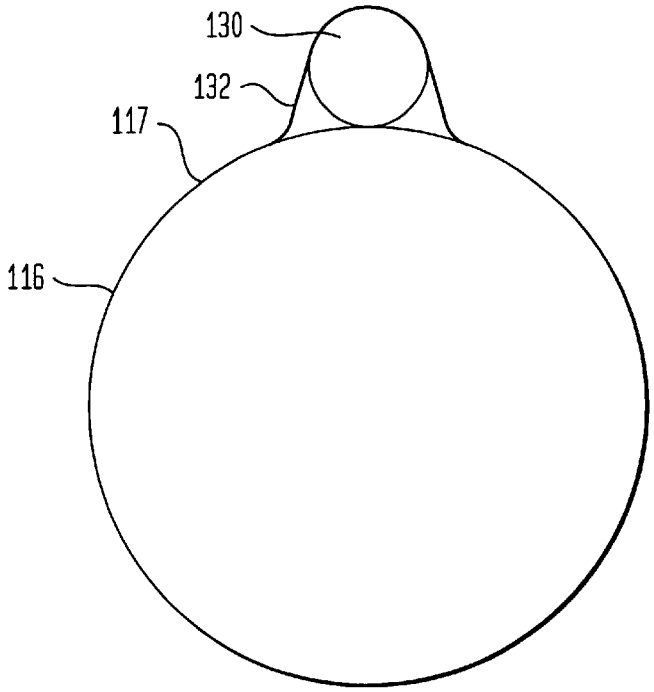
FIG. 3B shows a cross-sectional view of a fire fighting hose including a fiber optic cable attached to an exterior surface of the hose, in accordance with another preferred embodiment of the present invention.

FIG. 3B shows an illuminating fire hose 116 in accordance with another preferred embodiment of the present invention having fiber optic cable 130 attached to the exterior surface 117 thereof. The fiber optic cable 130 is secured to the exterior surface 117 of the fire hose by small threads or monofilaments 132 that are sewn into the fabric on the exterior surface 117 of the fire hose 116. As mentioned above, the light illuminating element attached to the hose may also comprise a chemiluminescent line wherein two or more chemicals mix together to produce light or a series of light emitting diodes.

Figure 4A:
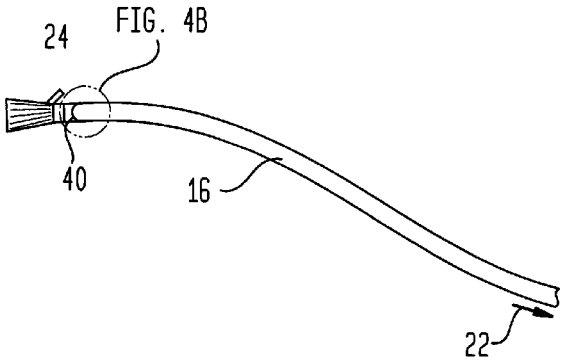
FIG. 4A shows a fragmentary view of a first one of the illuminating fire hoses of FIG. 1 including a fiber optic cable attached to the exterior surface of the hose, in accordance with certain preferred embodiments of the present invention.
Figure 4B:
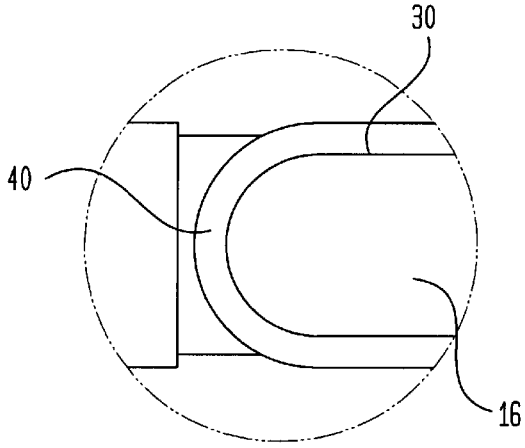
FIG. 4B shows an expanded view of a portion of the first fire hose shown in FIG. 4A.

FIGS. 4A and 4B show one preferred embodiment of the present invention having both ends of an optical fiber cable attached to a light source. Referring to FIG. 4A, fire hose 16 has optical fiber cable 30 attached to the exterior surface thereof. Adjacent the second end 24 of fire hose 16, fiber optic cable 30 loops back on itself at loop portion 40 and extends back toward the first end 22 of fire hose 16. The ends of the optical fiber cable are attached to the optical coupler 36 shown in FIGS. 1 and 2. Fiber optic cable may be attached to the exterior surface of fire hose 16 by a wide variety of methods including using an adhesive, such as a transparent adhesive, sewing the fiber optic cable to the exterior surface of the hose using fibers or monofilaments, or molding the fiber optic cable into the exterior wall of a rubberized, jacketed fire hose.

Figure 5A:
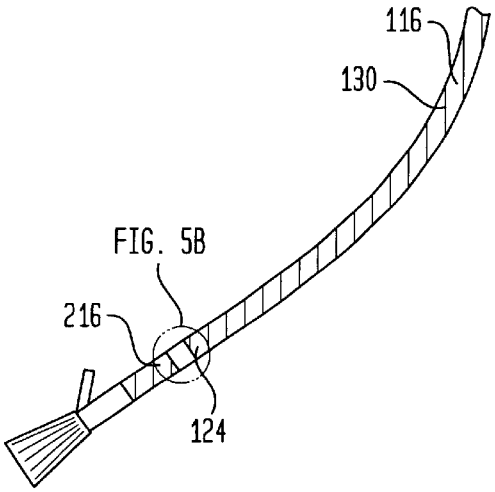
FIG. 5A shows a fragmentary view of a second one of the illuminating fire hoses of FIG. 1 including a fiber optic cable wrapped around and attached to the exterior surface of the hose, in accordance with further preferred embodiments of the present invention.
Figure 5B:
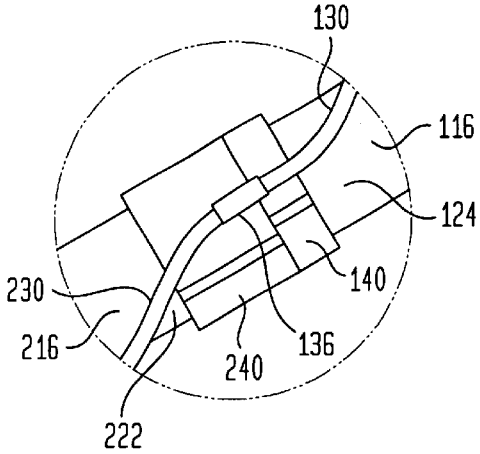
FIG. 5B shows an expanded view of a portion of the second illuminated fire hose shown in FIG. 5A including an interface between the ends of two adjacent fiber optic cables that are optically coupled together.

In certain embodiments, it may be necessary to attach one or more fire hoses together to form a longer hose and extend the operational range of the fire fighters operating the hose. Referring to FIGS. 5A and 5B, fire hose 116 has second end 124 including coupler 140. An optical fiber cable 130 is attached to the exterior surface of the hose 116. Optical fiber cable 130 is wrapped around the exterior surface of fire hose 116 in a coil-like manner or configuration. The fire hose 116 is coupled with fire hose extension 216 having a first end 222 including coupler 240. Fire hose extension 216 also has an optical fiber cable 230 attached to the exterior surface thereof and wrapped around the exterior surface of extension fire hose 216 in a coil-like configuration. The opposing ends of fiber optic cables 130 and 230 are optically coupled to one another via an optical connector 236 that receives opposing ends of the fiber optic cables 130 and 230. Although FIGS. 5A and 5B show two fire hoses connected together, other preferred embodiments of the present invention may have three, four or an infinite number of fire hoses coupled together. In the longer hoses, the opposing ends of all of the optical fiber cables may be optically coupled together so that light transmitted through a first optical fiber cable may continue in a downstream direction through the remaining fiber optic cables As a result, fire fighters may extend their operational range while maintaining visual contact with the light emanating from the optical fiber cables attached to the exterior surfaces of the hose sections.

Figure 6:
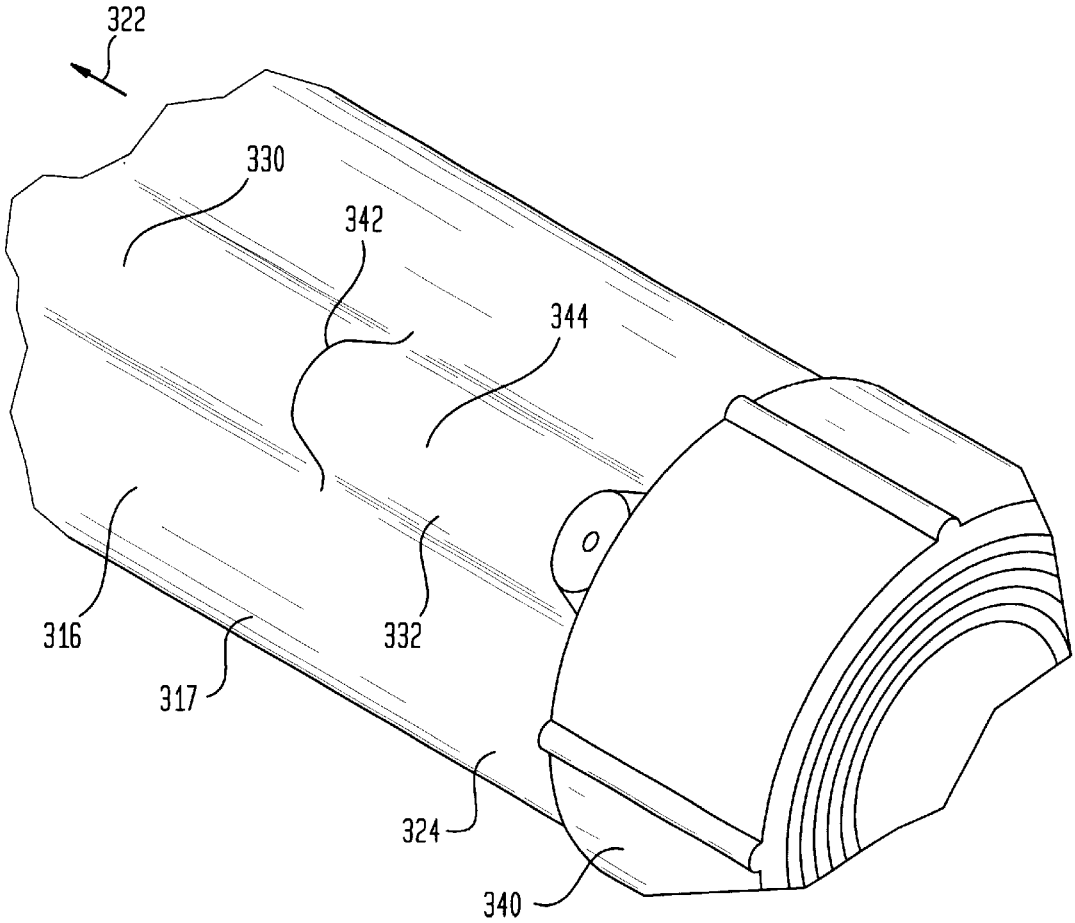
FIG. 6 shows a perspective view of a portion of an illuminated fire hose including an optical fiber attached to an exterior surface of the hose and a reflective end cap attached to an end of the optical fiber, in accordance with still further preferred embodiments of the present invention.

FIG. 6 shows an illuminating fire hose 316 in accordance yet further preferred embodiments of the present invention. Illuminating fire hose 316 has a first end 322 and a second end 324 remote therefrom. The second end 324 of hose 316 has a coupler 340 attached thereto for attaching the second end of the hose to another fire hose. A light-emitting fiber optic cable 330 is attached to the exterior surface 317 of fire hose 316. The fiber optic cable 330 may be attached to the exterior surface of fire hose 316 by an adhesive material, such as a transparent adhesive material which allows light to pass therethrough. The terminal end 342 of fiber optic cable 330 is attached to a reflecting end cap 344 which reflects the light transmitted through the end of fiber optic cable 330. The reflecting end cap 344 preferably reflects light back into the cable to help intensify the visible light throughout the length of the cable. Thus, by using a reflective end cap, a consistent level of light is provided throughout the length of the fiber optic cable and hose.

Figure 7A:
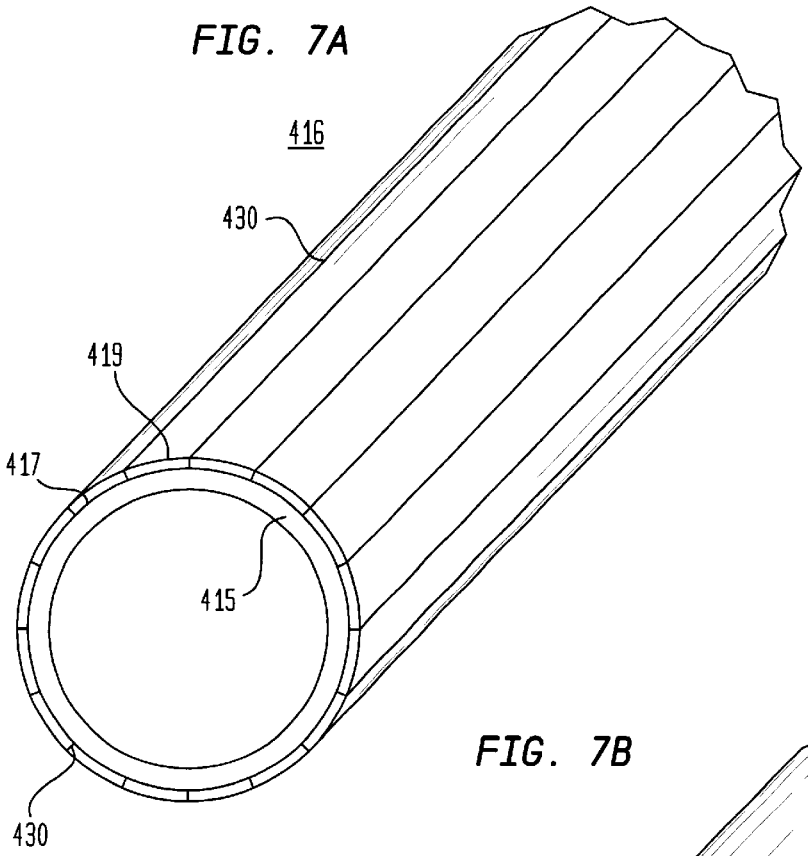
FIG. 7A shows a fragmentary view of an illuminating fire hose having optical fibers woven into an outer section of the hose.
Figure 7B:
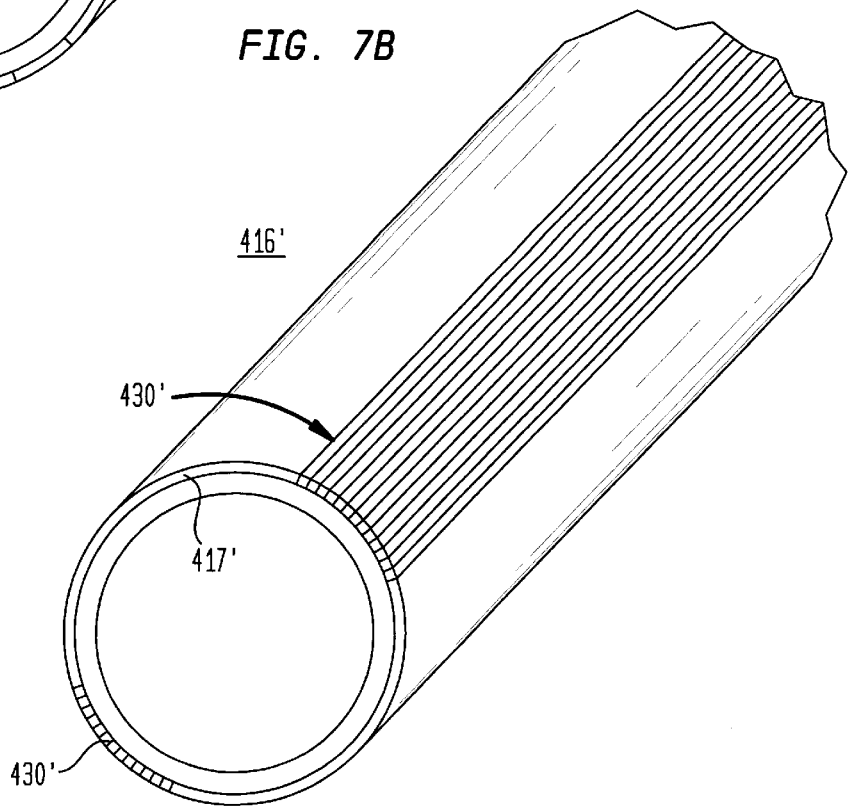
FIG. 7B shows a fragmentary view of an illuminating fire hose having optical fibers woven into an outer section of the hose, in accordance with further preferred embodiments of the present invention.

FIG. 7A shows an illuminating fire hose 416 in accordance with further preferred embodiments of the present invention including inner hose section 415 and outer hose section 417. The inner hose section 415 is preferably made of rubber and the outer hose section 417 is preferably made of a flexible, fire resistant material such as polyester. A plurality of optical fibers 430 are woven into the outer hose section 417. The plurality of optical fibers 430 are preferably exposed at an exterior surface 419 of the outer hose section 417. In operation, the optical fibers 430 may have light transmitted therethrough for providing illumination around the exterior surface of the fire hose 416. Fiber 7B shows a fire hose 416' in accordance with another preferred embodiment having optical fibers 430' woven into the outer hose section 417'. The spacing between the optical fibers 430' is less than the spacing shown in FIG. 7A.

Figure 8:
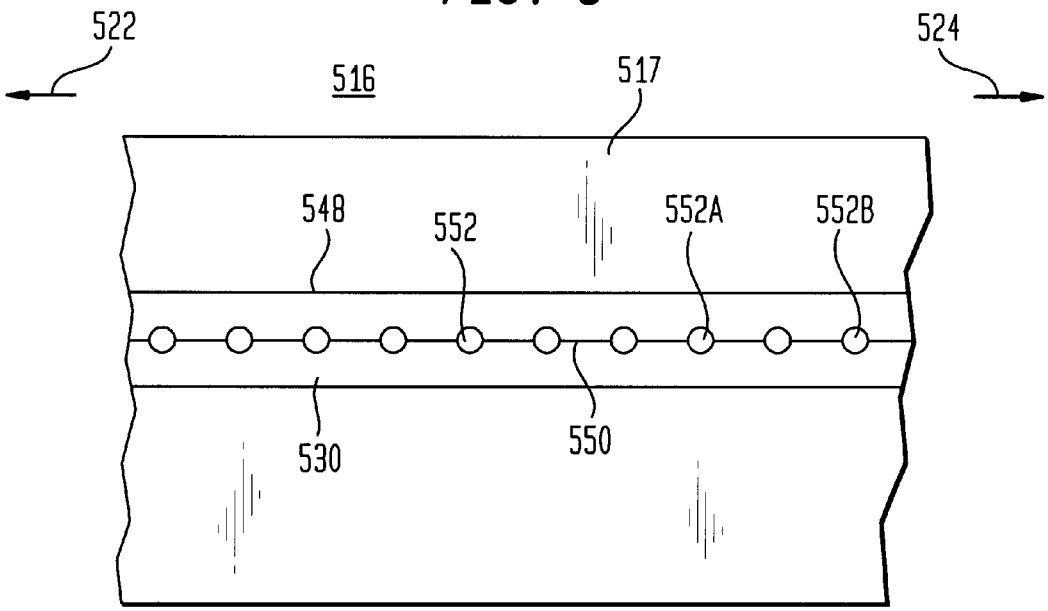
FIG. 8 shows a top fragmentary view of an illuminating fire hose including a series of light emitting diodes attached to the fire hose, in accordance with still further preferred embodiments of the present invention.

FIG. 8 shows another preferred embodiment of the present invention wherein a series of light emitting diodes 530 are attached to an exterior surface 517 of illuminating fire hose 516. The series of light emitting diodes 530 comprise a transparent strip 548 adhered to the exterior surface 517 of hose 516. The transparent strip preferably covers the light emitting diodes. The series of light emitting diodes 530 also includes individual light emitting diodes 552 that are interconnected with one another via conductive trace 550. The series of light emitting diodes may emit only one color, such as red. However, in other preferred embodiments, some of the diodes may emit light of one color while other diodes of the series emit light of another color. In the particular preferred embodiment shown in FIG. 8, light emitting diode 552A emits red light, while light emitting diode 552B emits green light. Activation of the different colors may be used to transmit messages to fire fighters utilizing the fire hose 516. For example, activating green may indicate a safe condition. Activating red may indicate an unsafe condition. In addition, at different times the light emitting diodes 552 may be selectively activated to indicate the direction toward the first end 522 of fire hose 516. As a result, the light emitting diodes 552 will be activated from the second end 524 of fire hose toward the first end 522 of fire hose to provide fire fighters with an indication of the direction to the first end 522 of fire hose 516. As a result, a disoriented or confused fire fighter may follow the light emitting diodes 552 when attempting to exit a room or building.

Figure 9:
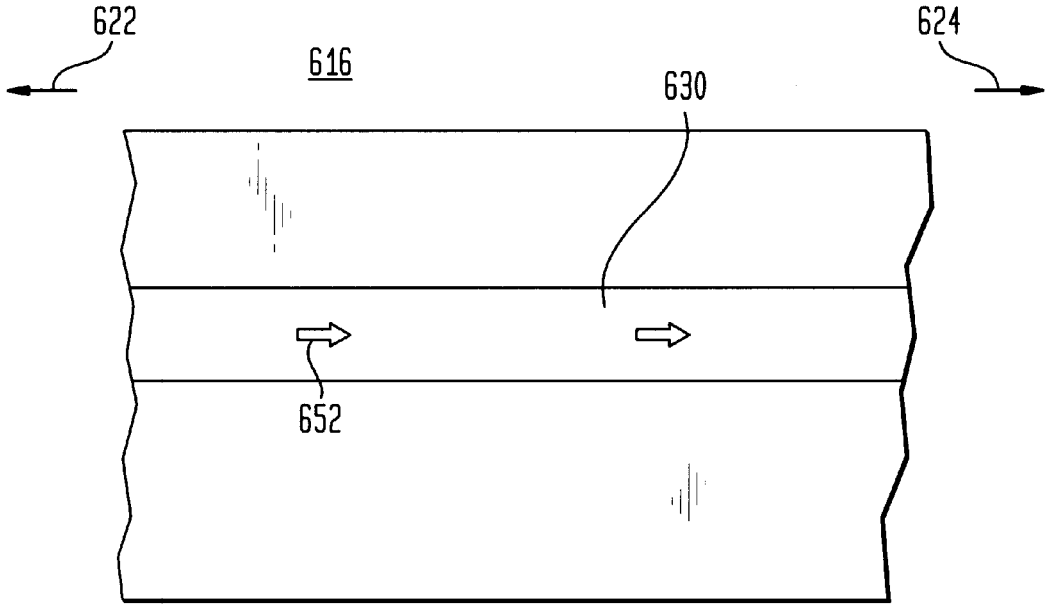
FIG. 9 shows a top fragmentary view of an illuminating fire hose including an optical fiber cable attached to the fire hose, the optical, in accordance with still further preferred embodiments of the present invention.

FIG. 9 shows another preferred embodiment of the present invention including fire hose 616 having a fiber optic cable 630 attached thereto. The fiber optic cable has an opaque sheathing around the outer surface thereof. The opaque sheathing provides an outline for one or more directional arrows 652 that point toward the direction of the exit of a room or building. When the fiber optic cable is illuminated, the arrows 652 will be illuminated to point toward the source end 624 of the hose 616 and away from the nozzle end 622 of the hose. Thus, a fire fighter may follow the arrows to exit a building.

These and other variations and combinations of the features described above can be utilized without departing from the present invention as defined by the claims. For example, the present invention is not limited to fire hoses but can be utilized with any hose or conduit that transfers liquids, fluids, gasses, solids or any combination of liquids, fluids, gasses and solids. As such, the foregoing description of the preferred embodiments should be taken by way of illustration rather than by way of limitation of the claimed invention.

What is claimed is:

1. An illuminating fire hose comprising:

a fire hose having a first end and a second end, said fire hose including an interior wall and an exterior wall remote therefrom; and at least one light emitting element exposed at the exterior surface of said fire hose for selectively emanating light.

2. The illuminating fire hose as claimed in claim 1, wherein said at least one light emitting element extends between the first and second ends of said fire hose.

3. The illuminating fire hose as claimed in claim 1, wherein said at least one light emitting element is attached to the exterior surface of said fire hose.

4. The illuminating fire hose as claimed in claim 3, wherein said at least one light emitting element is continuously exposed at the exterior surface of said fire hose.

5. The illuminating fire hose as claimed in claim 3, further comprising an epoxy adhesive for attaching said fiber optic cable to the exterior surface of said fire hose.

6. The illuminating fire hose as claimed in claim 5, wherein said adhesive is substantially transparent.

7. The illuminating fire hose as claimed in claim 3, further comprising one or more securing fibers wrapped around said at least one light emitting element for securing said at least one light emitting element to the exterior surface of said fire hose.

8. The illuminating fire hose as claimed in claim 7, wherein said one or more securing fibers include substantially transparent monofilaments.

9. The illuminating fire hose as claimed in claim 3, wherein said at least one light emitting element is wrapped around the exterior surface of said fire hose so as to provide illumination completely around the exterior surface of said fire hose.

10. The illuminating fire hose as claimed in claim 3, wherein said at least one light emitting element has a length that is greater than the distance between the first and second ends of said fire hose.

11. The illuminating fire hose as claimed in claim 1, wherein said at least one light emitting element has a first end and a second end remote from the first end.

12. The illuminating fire hose as claimed in claim 11, wherein said at least one light emitting element is adapted for transmitting light from the first end to the second end of said light emitting element.

13. The illuminating fire hose as claimed in claim 1, wherein said at least one light emitting element includes one or more optical fibers.

14. The illuminating fire hose as claimed in claim 13, wherein said optical fibers comprise a fiber optic cable.

15. The illuminating fire hose as claimed in claim 14, wherein an end of said at least one fiber optic cable is adapted for being coupled with a light source so that light generated by said light source may be transmitted through said fiber optic cable.

16. The illuminating fire hose as claimed in claim 1, wherein said at least one light emitting element has chemiluminescent properties.

17. The illuminating fire hose as claimed in claim 1, wherein said at least one light emitting element comprises a series of light emitting diodes.

18. The illuminating fire hose as claimed in claim 17, wherein said series of light emitting diodes may be selectively activated for indicating a direction to the first end of said fire hose.

19. The illuminating fire hose as claimed in claim 17, wherein said series of light emitting diodes are selected from a group consisting of white light emitting diodes, red light emitting diodes, green light emitting diodes, yellow light emitting diodes, blue light emitting diodes and orange light emitting diodes.

20. The illuminating fire hose as claimed in claim 18, wherein one or more of said light emitting diodes may be selectively activated for transmitting a message along the exterior surface of said fire hose.

21. The illuminating fire hose as claimed in claim 1, wherein said at least one light emitting element is a fiber optic cable having one or more directional arrows thereon, said fiber optic cable having an opaque sheathing providing an outline for said one or more directional arrows.

22. The illuminating fire hose as claimed in claim 21, wherein said directional arrows are spaced along a length of said fiber optic cable.

23. The illuminating fire hose as claimed in claim 1, wherein said fire hose includes an inner section and an outer section surrounding said inner section, said at least one light emitting element including optical fibers woven into said outer hose section.

24. The illuminating fire hose as claimed in claim 23, wherein said inner hose section comprises rubber and said outer hose section comprises polyester.

25. The illuminating fire hose as claimed in claim 1, further comprising a color filter in optical communication with said at least one light emitting element for changing the color of the light emanating therefrom.

26. An illuminating hose comprising:

a hose having a first end and a second end, said hose including an interior wall and an exterior wall; and at least one light emitting element attached to the exterior surface of said hose, wherein said at least one light emitting element selectively emanates light.

27. The illuminating hose as claimed in claim 26, wherein said at least one light emitting element is continuously exposed at the exterior surface of said hose.

28. The illuminating hose as claimed in claim 26, wherein said at least one light emitting element extends between the first and second ends of said hose.

29. The illuminating hose as claimed in claim 26, wherein said at least one light emitting element includes one or more fiber optic fibers.

30. The illuminating hose as claimed in claim 26, wherein said at least one light emitting element has chemiluminescent properties.

31. The illuminating hose as claimed in claim 30, wherein said at least one light emitting element has at least two chemicals that mix together to produce a chemical reaction that illuminates.

32. A combination comprising:

a fire hose having a first end and a second end, an interior wall and an exterior wall remote from said interior wall;

at least one fiber optic cable attached to the exterior surface of said fire hose; and a light source optically coupled to a first end of said fiber optic cable for transmitting light through said at least one fiber optic cable, wherein the light emanates from said at least one fiber optic cable for illuminating said fire hose.

33. The combination as claimed in claim 32, wherein said at least one fiber optic cable is continuously exposed at the exterior surface of said fire hose.

34. The combination as claimed in claim 32, wherein said at least one fiber optic cable is attached to the exterior surface of said fire hose.

35. The combination as claimed in claim 32, wherein said light source includes a multi-port optical connector, each port of said multi-port optical connector being adapted for optically coupling an end of said at least one optical fiber cable with said light source.

36. The combination as claimed in claim 32, wherein an end of said at least one fiber optic cable remote from the first end of said at least one fiber optic cable is optically coupled with a reflective end cap.

37. The combination as claimed in claim 32, said light source generating pulses of visible light that indicate a direction to the first end of said fire hose.

* * * * *